US008377284B2

(12) United States Patent
Gestermann et al.

(10) Patent No.: US 8,377,284 B2
(45) Date of Patent: Feb. 19, 2013

(54) METHOD OF RECYCLING PROCESS GAS IN ELECTROCHEMICAL PROCESSES

(75) Inventors: Fritz Gestermann, Leverkusen (DE); Thorsten Leidig, Duisburg (DE); Alfred Soppe, Issum (DE)

(73) Assignee: Bayer MaterialScience AG, Leverkusen (DE)

( * ) Notice: Subject to any disclaimer, the term of this patent is extended or adjusted under 35 U.S.C. 154(b) by 0 days.

(21) Appl. No.: 12/436,559

(22) Filed: May 6, 2009

(65) Prior Publication Data

US 2009/0211915 A1 Aug. 27, 2009

Related U.S. Application Data

(63) Continuation of application No. 10/491,757, filed as application No. PCT/EP02/10841 on Sep. 27, 2002, now abandoned.

(30) Foreign Application Priority Data

Oct. 9, 2001 (DE) ..... 101 49 779

(51) Int. Cl.
*C25B 1/26* (2006.01)

(52) U.S. Cl. ..... 205/620; 204/237

(58) Field of Classification Search ..... 205/620; 204/237

See application file for complete search history.

(56) References Cited

U.S. PATENT DOCUMENTS

| | | | | |
|---|---|---|---|---|
| 3,652,431 | A | 3/1972 | Reynolds | |
| 3,718,506 | A | 2/1973 | Fischer et al. | |
| 4,173,524 | A | 11/1979 | McRae | |
| 4,632,649 | A | 12/1986 | Segebrecht et al. | |
| 4,657,651 | A | 4/1987 | Wainerdi | |
| 5,441,821 | A | 8/1995 | Merritt et al. | |
| 5,843,297 | A | 12/1998 | Schmid et al. | |
| 5,958,197 | A | 9/1999 | Allen et al. | |
| 5,961,813 | A | 10/1999 | Allen et al. | |
| 6,149,782 | A | 11/2000 | Allen et al. | |
| 6,224,740 | B1 | 5/2001 | Gestermann et al. | |
| 6,348,143 | B1 | 2/2002 | Serikawa et al. | |
| 2002/0022172 | A1 * | 2/2002 | Sahoda et al. | 429/34 |
| 2006/0251935 | A1 | 11/2006 | Barrett et al. | |

FOREIGN PATENT DOCUMENTS

| | | | |
|---|---|---|---|
| DE | 0711729 | | 5/1996 |
| EP | 1061158 | A2 | 12/2000 |
| EP | 0785294 | B1 | 10/2001 |
| WO | WO-03/064728 | | 8/2003 |

* cited by examiner

*Primary Examiner* — Nicholas A. Smith
(74) *Attorney, Agent, or Firm* — Connolly Bove Lodge & Hutz LLP

(57) ABSTRACT

The invention relates to a method for recycling educt-containing process gas (residual gas) in electrochemical processes with at least one gas diffusion electrode while using a gas jet pump for directly reintroducing the residual gas in the electrochemical process.

15 Claims, 1 Drawing Sheet

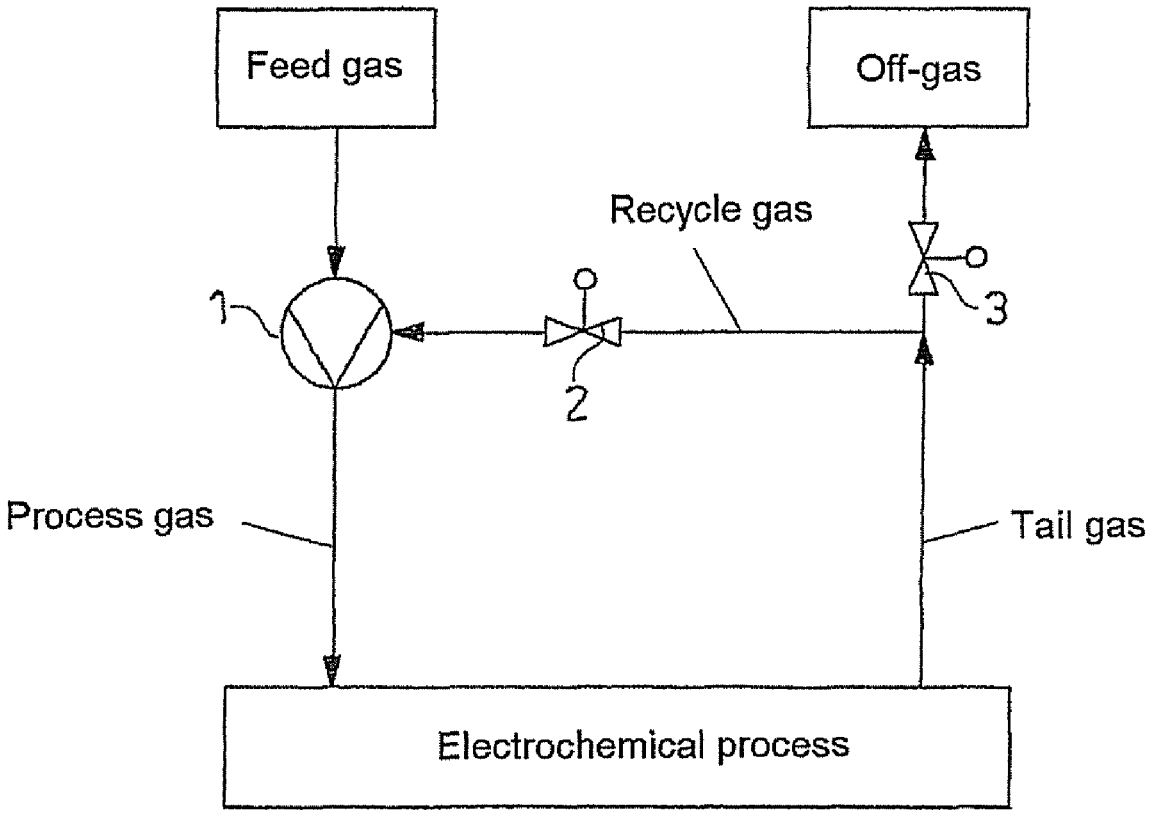
Feed gas
Off-gas
Recycle gas
1
2
3
Process gas
Tail gas
Electrochemical process

METHOD OF RECYCLING PROCESS GAS IN ELECTROCHEMICAL PROCESSES

RELATED APPLICATIONS

This application is a continuation of U.S. patent application Ser. No. 10/491,757, filed Apr. 9, 2004, which is a national stage application (under 35 U.S.C. §371) of PCT/EP02/10841, filed Sep. 27, 2002, now abandoned, which claims benefit of German Patent Application No. 101 49 779.2, filed Oct. 9, 2001.

The invention relates to a method of recycling process gas in electrochemical processes involving gas diffusion electrodes.

Various chemical processes require the use of gaseous feeds in stoichiometric excess. A stoichiometric excess of feed gas is required, for example, where electrochemical cells based on gas diffusion electrodes are used.

The use of gas diffusion electrodes permits alternative reaction routes in various electrochemical processes while avoiding undesirable or uneconomic by-products.

One example of a gas diffusion electrode is the oxygen-consuming cathode. This electrode is an open-pored membrane which is disposed between the electrolyte and the gas space and includes an electroconductive layer comprising catalyst. This arrangement ensures that the oxygen reduction at the three-phase boundary between electrolyte, catalyst and oxygen takes place as close as possible to the electrolyte. As described, for example, in U.S. Pat. No. 4,657,651, oxygen-consuming cathodes are used, for example, in alkali metal halide electrolysis.

In the case of the oxygen-consuming cathode, oxygen is added, inter alia, as a feed gas. With known methods, the tail gas produced, which still contains oxygen, is removed from the process and fed into the off-gas without being used again. Drawbacks of the previous procedure include, on the one hand, the high oxygen consumption and, on the other hand, the laborious cleaning required before the tail gas is discharged into the environment, e.g. by means of scrubbing columns. Implementation on an industrial scale therefore, as well as entailing significant costs of raw materials, also places higher requirement on special methods and equipment for cleaning off-gases. Alternatively, the tail gas can also be processed for re-use, although this does likewise require scrubbing columns or filters and compressors for recycling into the process. Recycling into the process by means of a compressor then, because of the hydrogen chloride (HCl) and possible chlorine content of the tail gas, requires high-quality materials for the compressor or alternatively requires the recycled gas flow to be continuously scrubbed with caustic soda solution, involving high consumption of caustic soda solution.

In another known approach, excess process gas in various processes is actively recycled into the electrolytic process by means of compressors or blowers. A drawback of thus controlling the process is the high outlay for investment, operation (e.g. electrical energy) and maintenance. Moreover, active compressors must be monitored for correct operation, involving complex process control engineering.

Finally, it is known to employ gas jet pumps for generating a vacuum, mixing gases and recovering heat (thermocompressors/vapour compressors). Gas jet pumps are working-fluid pumps which generate a negative pressure and are particularly suitable for use as a vacuum pump. Except for the choice of a gaseous working fluid, gas jet pumps correspond to liquid jet pumps. One example of a possible working fluid is steam.

It is an object of the invention to provide a reprocessing method for tail gases in electrolytic processes involving gas diffusion electrodes which does not have the abovementioned drawbacks. In particular, the consumption of feed gases is to be reduced, and downscaling of requisite scrubbers is to be achieved, resulting in reduced consumption of scrubbing media. Furthermore, the use of cost-intensive compressors (investment, operating and maintenance costs) should be done away with. At the same time, damage to the membrane and to the delicate gas diffusion electrode is to be avoided.

A method of recycling process gas in electrochemical processes, especially in electrolytic processes, involving at least one gas diffusion electrode has been found which comprises at least the following steps:

- feeding feed gas into the electrochemical process under a pressure which exceeds the process pressure, via a gas jet pump,
- expanding the feed gas to process pressure in a gas jet pump, generating a suction pressure which is less than the process pressure, and
- aspirating feed gas-containing process gas (tail gas) by means of the suction pressure generated in the gas jet pump and recycling tail gas into the electrochemical process.

It has been found, surprisingly, that the use of a gas jet pump permits the tail gas rich in feed gas to be recycled directly into the process, without any drying or cleaning being required. Consequently, even the feed gas humidification required in processes known hitherto can be dispensed with. The simple design of the gas jet pump allows high-quality materials to be used cost-effectively. The working fluid used can be the feed gas required in the process. The consumption of feed gas can be significantly reduced, as the excess required for the process is achieved via the recycled tail gas. This also leads to downscaling of requisite scrubbers and consequently also to reduced consumption of scrubbing media for the off-gases. By controlling the flow rate of the recycled gas stream and as a result of the free outflow of the removed tail gas it is possible, in addition, to avoid excess pressure or pressure fluctuations, which could cause membrane and electrode damage, in the electrode compartments of the electrolysis.

A significant aspect of the invention is that the tail-gas excess produced in electrolytic processes involving gas diffusion electrodes and hitherto discharged as off-gas is recycled directly into the process. This results in reduced consumption of feed gas, without the operation of the delicate gas diffusion electrode being impaired. Preferably, not the entire tail-gas stream is discharged into the exhaust air but only a substream of the tail gas, to avoid a build-up of impurities and excess pressure or pressure fluctuations, which could result in membrane and electrode damage, in the electrode compartment, especially in the cathode compartment, of the electrolysis. The use of a gas jet pump allows the tail gas rich in feed gas to be recycled directly into the process, without any drying or cleaning being required.

A preferred embodiment of the invention therefore comprises recycling of tail gas into the process via a gas jet pump using the pressure differential of feed gas and process gas as the driving force, controlling the recycled gas flow rate, and the outflow of a tail gas substream to remove impurities and to avoid excess pressure.

In the method according to the invention, the tail gas is preferably recycled into the process together with the feed gas via a gas jet pump.

BRIEF DESCRIPTION OF THE FIGURES

FIG. 1 illustrates a schematic depiction of an embodiment of a method of recycling a process gas in electrochemical processes.

The advantages of the method according to the invention become particularly clear in view of the following:

The tail gas produced in HCl or NaCl membrane electrolysis mainly contains oxygen and additionally water vapour, HCl and, in the event of membrane damage, also contains chlorine. In the case of NaCl electrolysis involving an oxygen-consuming cathode, the tail gas might contain traces of caustic soda (NaOH). Discharging the tail gas as exhaust air would require a large-scale exhaust-air scrubber and high consumption of caustic soda solution for scrubbing. At the same time, the oxygen, employed in a 50% excess, would be discharged as exhaust air. Because of the HCl and possible chlorine content of the tail gas, recycling into the process by means of a compressor would require expensive materials for the compressor or continuous scrubbing of the recycled amount of gas, with high consumption of caustic soda solution.

The inventive use of a gas jet pump now permits direct recycling of feed gas-containing tail gas into the process, without any drying or cleaning being required. Consequently, the previously required humidification of the feed gas can be dispensed with. The oxygen consumption can be reduced by about 33%, since the excess required for the process is achieved by virtue of the recycled tail gas which, at a volume flow rate which is preferably greater than 90% of the tail-gas stream and, if required, can be adjusted via a control member, is available to the process once more. The non-recycled fraction of the tail-gas stream is fed into the off-gas at a volume flow rate which is preferably less than about 10%, particularly preferably less than about 1% of the level of pure oxygen in the feed gas. By virtue of flow rate control of the recycled gas stream and by virtue of the outflow of the discharged tail gas, excess pressure or pressure fluctuations, which can cause membrane and electrode damage, in the cathode compartment of the electrolysis are avoided. The outflow of the non-recycled fraction of the tail-gas stream moreover avoids the build-up of impurities, especially of inert gases, in the process.

The method according to the invention can be employed in any electrochemical process which requires the use of gaseous feeds in stoichiometric excess.

In addition, the method according to the invention can make use of any type of gas diffusion electrode, e.g. an oxygen-consuming cathode.

The method according to the invention is preferentially used in electrochemical processes, especially in electrolytic processes, which proceed making use of an oxygen-consuming cathode. The method is also preferentially employed in electrolytic processes in which essentially oxygen is introduced as a feed gas.

Examples of electrolytic processes which can be carried out in accordance with the method according to the invention include, in particular, NaCl and HCl electrolysis, but also e.g. methods of recycling ammonium sulphate or ammonium nitrate, making use of oxygen-consuming cathodes.

Particularly preferred electrolytic processes are NaCl electrolysis and HCl electrolysis involving oxygen-consuming cathodes, in which oxygen is introduced in about 50% stoichiometric excess, based on pure oxygen.

The process pressure at which the electrochemical process operates depends on the nature of the electrochemical process and the gas diffusion electrode chosen and is generally in the range of from 0.001 to 10 bar, preferably from 10 to 250 mbar, especially from 10 to 200 mbar, above atmospheric pressure, particularly preferably at atmospheric pressure.

The feed gas pressure applied to the gas jet pump generally exceeds the process pressure by from 0.1 to 40 bar. Preferably, the feed gas pressure exceeds the process pressure by from 0.5 to 25 bar, especially from 0.5 to 10 bar.

In an alternative embodiment of the method according to the invention the process pressure applied to the gas jet pump is from 1 to 500 mbar, preferably from 50 to 200 mbar, below atmospheric pressure.

In the case where the process pressure is below atmospheric pressure, the off-gas is pressurized with the aid of a compressor or a blower for the purpose of ejecting it at atmospheric pressure.

Preferably, the feed gas is fed to the gas jet pump at a flow rate which corresponds to a 1.01- to 10-fold excess, especially a 1.5 to 2-fold excess, based on pure feed gas, compared with the stoichiometric consumption of the electrochemical process. If the feed gas used contains impurities such as e.g. inert gases, the process must be ran at a correspondingly higher superstoichiometry.

In the gas jet pump, the feed gas is expanded to the process pressure and is introduced to the reaction chamber in which the electrochemical process takes place (e.g. into the cathode compartment of the electrolysis apparatus). The process pressure preferably corresponds to the operating pressure of the gas diffusion electrode plus any pressure lost in the lines. Preferably, the process pressure approximately corresponds to atmospheric pressure. A superstoichiometric fraction of the feed gas is passed out from the process as tail gas.

The suction pressure generated when the feed gas is expanded causes at least a fraction of the tail gas to be aspirated via the suction side of the gas jet pump and to be recycled into the process. The suction rate of the gas jet pump can be controlled via the gradient between feed gas pressure and process pressure.

According to a preferred embodiment of the invention, the tail-gas stream recycled into the electrolytic process is adjusted via a control member provided in the tail-gas stream, off-gas stream and/or recycling-gas stream. With the aid of the control member, the amount of the tail gas to be recycled into the process can be adjusted to from 0.01 to 100%, based on the tail gas. Preferably, the amount of the tail gas to be recycled into the process is adjusted to values of from 80 to 99.5%.

That proportion of the tail-gas stream which is not recycled into the process gas stream is fed into the off-gas. The build-up of impurities in the process is thus restricted. Moreover, as a result of the outflow of this gas stream, the build-up of an undesirably large excess pressure in the process is avoided. This is the case, in particular, in the event of the electrolysis having been switched off, since in this case oxygen is no longer consumed in the process. For the purpose of controlling the tail gas fed in to the off-gas, a control member can be provided in the off-gas stream.

The method according to the invention is preferably implemented under essentially atmospheric process pressure with free outflow of the off-gas.

If the method according to the invention is implemented in NaCl electrolysis by the use of an oxygen-consuming cathode, the oxygen-consuming cathode is preferably configured as described in EP-A-1 061 158. In particular, the oxygen-consuming cathode preferably includes, as a metallic support for distributing the electrons, a fabric of silver wire or silvered nickel wire or some other alkali-resistant alloy, e.g. Inconel. So as to avoid poorly conductive oxide or hydroxide layers, the alloy in question should likewise be silvered or surface-treated in some other way. Of particular advantage is the use of a deeply patterned support such as e.g. felt made of fine fibres of the abovementioned fabric material. The catalyst matrix preferably comprises a mixture of Teflon (to adjust the hydrophobicity and the porosity for gas diffusion), an electroconductive support, e.g. Vulcan black or acetylene black, and the catalyst material itself, which is finely dispersed therein and is mixed in the form of catalytically active silver particles. The catalyst matrix is preferably sinter-bonded or pressure-bonded to the support. Alternatively, it is possible to dispense with the carbon fractions (carbon black) if the catalyst density and/or the hydrophobic support which has been rendered conductive are adjusted in such a way that most of the catalyst particles are also in electrical contact.

As described in EP-A-1 061 158, it is possible, especially in NaCl electrolysis, to dispense with the presence of carbon black in the oxygen-consuming electrode, so that the electrode matrix consists solely of Teflon and silver, the silver assuming the function of electron conduction as well as that of catalyst. Accordingly, a silver coverage is required which is sufficient for the particles to touch and to form conductive bridges between one another. The support used can be in the form of the wire fabric, an expanded-metal foil, as known from battery technology, or a felt made of silver, silvered nickel or silvered alkali-resistant material, e.g. Inconel steel According to a further preferred embodiment of the invention, the method according to the invention is employed in HCl membrane electrolysis with an oxygen-consuming cathode.

The practice of HCl membrane electrolysis by means of oxygen-consuming cathodes is generally known to those skilled in the art and is described, for example, in EP-A-0 785 294, U.S. Pat. No. 5,958,197 and U.S. Pat. No. 6,149,782, which are expressly incorporated by reference. The method according to the invention can be implemented by means of the oxygen-consuming cathodes described in these publications.

The method according to the invention is particularly suitable for implementation in conjunction with dimensionally stable gas diffusion electrodes, especially with the dimensionally stable gas diffusion electrode described below:

A dimensionally stable gas diffusion electrode preferentially usable in the method according to the invention comprises at least one electroconductive catalyst support material for accommodating a catalyst material-containing coating composition, in particular mixtures of finely dispersed silver powder or finely dispersed silver oxide powder or mixtures of silver powder and silver oxide powder and Teflon powder or mixtures of finely dispersed silver powder or silver oxide powder or mixtures of silver powder and silver oxide powder, carbon powder and Teflon powder, and an electrical connection, the catalyst support material being a fabric, bonded fibre web, sintered metal, foam or felt of electroconductive material, an expanded-metal plate or a metal plate that is provided with a multiplicity of perforations. The catalyst material-containing coating composition is applied on top of said catalyst support material which has sufficient flexural strength for additional stiffening using an additional base plate to be dispensed with, or which is mechanically and electroconductively connected to a gas-permeable stiff metallic base plate or a stiff fabric or expanded metal, in particular made of nickel or its alloys or alkali-resistant metal alloys.

The open structure serving as a catalyst support material comprises, in particular, a fine wire fabric or a corresponding expanded-metal foil, filter screen, felt, foam or sintered material with which the catalyst material-containing coating composition interlocks when it is rolled in. In one embodiment, said open structure, prior to the catalyst material-containing coating composition being pressed in or rolled in, is metallically bonded, e.g. by sinter-bonding, to the quite open, but more compact and stiff substructure itself.

The function of said substructure is that of an abutment during the operation of pressing in the catalyst material-containing coating composition which, in the process, is quite able to spread out even into structure-related interstices between the two layers and consequently to interlock even more effectively.

The metal for the base plate is preferably selected from the group consisting of nickel or an alkali-resistant nickel alloy or nickel coated with silver, or from an alkali-resistant metal alloy.

Alternatively, in special cases the base plate used can be a stiff foam or a stiff sintered structure or a perforated plate or a slotted plate made from a material from the group consisting of nickel, alkali-resistant nickel alloy or alkali-resistant metal alloy or nickel plated with silver. In this case, the catalyst material-containing coating composition which, in a previous process step, has been rolled out into a rough sheet, is rolled directly into the base structure which at the same time acts as a catalyst support material. No additional catalyst support material is used therefore.

The catalyst support material preferably comprises carbon, metal, particularly nickel or nickel alloys or an alkali-resistant metal alloy.

So that reaction gas can be passed more effectively through the base plate, the latter preferably has a multiplicity of perforations, particularly slots or cylindrical holes.

The perforations preferably have a width of at most 2 mm, in particular at most 1.5 mm. The slots can have a length of up to 30 mm.

If a foam or porous sintered structure is used, the pores have a mean diameter of preferably at most 2 mm. The structure is distinguished by high stiffness and flexible strength.

Preferably, the gas diffusion electrode catalyst support material used is a foam or sintered-metal body, a rim provided for connecting the electrode to an electrochemical reaction apparatus being compressed in order to achieve the gas/liquid-tightness required.

A preferred variant of the gas diffusion electrode which can be used in the method according to the invention is characterized in that the base plate has an unperforated surrounding rim of a least 5 mm which serves to secure the electrode, especially by welding or soldering or by means of bolting or riveting or clamping or by using an electroconductive adhesive, to the rim of the gas pocket to be connected to the electrode.

A further preferred form of the gas diffusion electrode which can be used in the method according to the invention is characterized in that the catalyst support material and the catalyst material-containing coating composition are bonded together by dry calendering.

A preferred variant of the gas diffusion electrode which can be used in the method according to the invention is of such a design that the catalyst support material and the catalyst material-containing coating composition is applied to the catalyst support material by pouring or wet-rolling of the coating composition containing water and possibly organic solvent (e.g. alcohol), and is bonded by subsequent drying, sintering and possibly by densification.

To achieve improved uniform gas distribution within the gas diffusion electrode, provision is made, in a special design, between the base plate and the catalyst support material, of an additional electroconductive gas distributor fabric, especially made of carbon or metal, especially nickel, or an alkali-resistant nickel alloy or nickel coated in silver, or with an alkali-resistant metal alloy.

In a special embodiment of said gas diffusion electrode which can be used in the method according to the invention, the base plate has an areal recess for accommodating the gas distributor fabric.

Found to be particularly suitable for use in the method according to invention is a design of the gas diffusion electrode in which the layer of catalyst support material and catalyst material-containing coating composition forms a circumferentially gas-tight join to the rim of the base plate in the rim region of the electrode.

The gas-tight join can be achieved, for example, by sealing or, if required, by ultrasound-assisted flat-rolling.

If a foam or porous sintered structure is used as the catalyst support material or the base plate, coating of the structure with catalyst material-containing coating composition is followed by firm pressure-bonding of a circumferential rim region to achieve a gas-tight rim region.

The gas diffusion electrode preferably has a rim without perforations or a rim sealed by pressure-bonding a porous base structure, and, at said unperforated rim, is joined gas-tightly and electroconductively to an electrochemical reaction apparatus, for example by means of welding, soldering, bolting, riveting, clamping or the use of alkali-resistant, electroconductive adhesive.

If the gas diffusion electrode is joined to the electrochemical reaction apparatus by means of welding or soldering, the unperforated rim is preferably free from silver.

If, on the other hand, the gas diffusion electrode is joined to the electrochemical reaction apparatus by means of bolting, riveting, clamping, or the use of electroconductive adhesive, the unperforated rim preferably contains silver.

When the gas diffusion electrode is integrated into the electrochemical reaction apparatus by bolting, riveting, clamping, the rim region of the base plate is advantageously sealed against the mounting plane of the electrochemical apparatus by means of a resilient liner.

The invention is described below in more detail with reference to an illustrative embodiment with reference to the accompanying FIG. 1, where FIG. 1 shows a schematic depiction of a specific embodiment of the method according to invention.

EXAMPLE

An HCl membrane electrolysis was carried out using 76 cell elements of 2.5 $m^2$ each, using the configuration sketched in FIG. 1, using an oxygen-consuming cathode and a gas jet pump 1 from Körting, Hanover, at a specific current density of 4 $kA/m^2$, the cathode compartment of the electrolyser being fed with 255 $m^3_N/h$ of pure oxygen, i.e. in excess of about 50%. The outflowing tail gas mainly contains oxygen and additionally water vapour and traces of HCl.

The oxygen was fed to the electrolysis process under a pressure of 4.8 bar (feed gas pressure) via a gas jet pump 1 and was expanded therein to about atmospheric pressure (process pressure), the resulting pressure differential serving as the driving force for aspirating and mixing the excess tail gas containing unconsumed oxygen. The unconsumed oxygen is consequently available as a process gas to the oxygen-consuming cathode during the membrane electrolysis. The feed gas-containing tail gas was once more fed into the process by the gas jet pump 1 via a control valve 2. A substream of the tail gas was fed, via a servo-valve 3, into the off-gas stream, the off-gas stream being designed in such a way that it cannot be shut off, to prevent excess pressure from building up and to remove impurities.

As a result of using the gas jet pump in the method according to the invention, the oxygen-rich tail gas was recycled into the process, without any drying or cleaning being required. Consequently, even feed gas humidification which had hitherto been required in NaCl electrolyses could be dispensed with. The oxygen consumption could be reduced from 255 $m^3_N/h$ to about 170 $m^3_N/h$, as the excess required for the process is achieved by virtue of the recycled tail gas. This means a saving of about 75 $m^3_N/h$ compared with a non-recycling process. By virtue of the free outflow of the removed tail gas, the build-up of excess pressure and/or pressure fluctuations in the cathode compartment of the electrolysis, which can lead to membrane and electrode damage, were avoided.

The invention claimed is:

1. A method of recycling process gas into an electrochemical process comprising at least one gas diffusion electrode, said method comprising:

feeding feed gas into the electrochemical process via a gas jet pump under a pressure which exceeds a process pressure, expanding the feed gas to process pressure in a gas jet pump, and generating a suction pressure which is less than the process pressure, and aspirating feed gas-containing tail gas by means of the suction pressure generated in a gas jet pump and recycling the tail gas into the electrochemical process via at least one control member, wherein the at least one control member is positioned in the tail-gas stream, off-gas stream and/or recycling-gas stream;

wherein the feed gas and tail gas are fed into the electrochemical process in 1.01- to 10-fold stoichiometric excess, based on consumption of feed gas in the electrochemical process.

2. The method of claim 1, wherein a part of the tail gas is discharged as an off-gas stream.

3. The method of claim 2, wherein the process pressure is controlled via a further control member in the off-gas stream.

4. The method of claim 3, wherein the feed gas pressure exceeds the process pressure by from 0.1 to 40 bar.

5. The method of claim 2, wherein the electrochemical process is carried out under atmospheric pressure.

6. The method of claim 2, wherein the process pressure is from 1 to 500 mbar below atmospheric pressure.

7. The method of claim 2, wherein the feed gas pressure exceeds the process pressure by from 0.1 to 40 bar.

8. The method of claim 1, wherein the tail gas is fed to the electrochemical process via the gas jet pump together with feed gas.

9. The method of claim 8, wherein the feed gas pressure exceeds the process pressure by from 0.1 to 40 bar.

10. The method of claim 1, wherein the process pressure exceeds atmospheric pressure by from 0.001 to 10 bar.

11. The method of claim 1, wherein the electrochemical process is carried out under atmospheric pressure.

12. The method of claim 1, wherein the process pressure is from 1 to 500 mbar below atmospheric pressure.

13. The method of claim 1, wherein the feed gas pressure exceeds the process pressure by from 0.1 to 40 bar.

14. The method of claim 1, wherein the tail gas is recycled into the electrochemical process via at least one control valve positioned on the recycle stream.

15. The method of claim 1, wherein the recycled tail gas is fed directly into the gas jet pump.

* * * * *